US005159150A

United States Patent [19]

Wardecki

[11] Patent Number: 5,159,150

[45] Date of Patent: Oct. 27, 1992

[54] ARRANGEMENT TO PREVENT A PREMATURE IGNITION OF AN ACTIVE CHARGE OF A PROJECTILE

[75] Inventor: Norbert Wardecki, Glottertal, Fed. Rep. of Germany

[73] Assignee: Buck Werke GmbH & Co., Bad uberkingen, Fed. Rep. of Germany

[21] Appl. No.: 832,880

[22] Filed: Feb. 10, 1992

[30] Foreign Application Priority Data

Feb. 20, 1991 [DE] Fed. Rep. of Germany ..... 4105271

[51] Int. Cl.[5] ..... F42C 15/16

[52] U.S. Cl. ..... 102/259; 102/226; 102/251

[58] Field of Search ..... 102/259, 229, 247, 251, 102/223, 258, 254

[56] References Cited

U.S. PATENT DOCUMENTS

| | | | |
|---|---|---|---|
| 2,118,062 | 5/1938 | Woodberry | 102/251 |
| 2,981,192 | 4/1961 | Grandy | 102/259 |
| 4,699,058 | 10/1987 | Popovitch | 102/259 |
| 4,704,965 | 11/1987 | Kratz et al. | 102/226 |
| 4,953,475 | 9/1990 | Monach et al. | 102/229 |
| 4,982,663 | 1/1991 | Scheve et al. | 102/259 |

FOREIGN PATENT DOCUMENTS 3543939 12/1985 Fed. Rep. of Germany .

*Primary Examiner*—David H. Brown

*Attorney, Agent, or Firm*—Watson, Cole, Grindle & Watson

[57] ABSTRACT

An arrangement to prevent a premature ignition of an active charge, which is to be ignited by means of an adjustable time-delay fuse and is provided for a projectile that is expended from a firing barrel by means of a charge, includes both a mechanical and a pyrotechnical safety element. The ignition path between a first delay element that can be ignited while firing and the active charge of the projectile can be blocked by a barrel probe movable at right angles to the firing direction, and in its position blocking the ignition path can be arrested by an acceleration probe movable counter to the firing direction and, as long as the projectile is located in the firing barrel, by the firing barrel wall. A second delay element which can also be ignited while firing and exhibits a shorter delay period than the first delay element pressurizes the barrel probe with gas pressure in the direction of its end safety position following expiration of its delay period.

6 Claims, 2 Drawing Sheets

ARRANGEMENT TO PREVENT A PREMATURE IGNITION OF AN ACTIVE CHARGE OF A PROJECTILE

BACKGROUND OF THE INVENTION

The invention generally relates to an arrangement to prevent a premature ignition of an active charge that is to be ignited by means of an adjustable time-delay fuse and is provided for a projectile that is expended from a firing barrel by means of a charge.

More particularly, the present arrangement comprises a pyrotechnical delay element that can be ignited while firing and in turn ignites the active charge. The arrangement includes an acceleration probe located in the safety position, and during acceleration of the projectile to a specified firing velocity such probe moves as a consequence of its inertia against the firing direction into an end safety position. A barrel probe movable at right angles to the firing direction can be moved out of its safety position with the projectile shell into an armed position in which it projects laterally beyond the jacket of the projectile. The delay element and the active charge interact for ignition only if the acceleration probe and the barrel probe are simultaneously in the armed position.

In German Pat. No. 35 43 939, the acceleration probe and the barrel probe are clamped into an arm position. The acceleration probe is coupled by means of a locking bolt to a spring-loaded delay-action probe, and a communicating charge, which can be displaced by a spring braked by a jamming member, is located between the delay element and the active charge. The object of this arrangement is that, when the discharge has exceeded the specified allowable maximum acceleration or when the projectile accelerated to the specified maximum acceleration has dropped below the allowable deceleration in the firing barrel, the active charge cannot be ignited, thus availing a barrel burst. In addition, with a faulty delay element or faulty adjustment of the time-delay fuse the active charge cannot be prematurely ignited before reaching a specified safe distance of the projectile from the firing barrel which takes into account the current safety regulations requiring independent physical values for safety.

However, production of this arrangement is difficult and costly owing to the comparatively expensive construction and the requirement of precise coordination of the springs that are used.

SUMMARY OF THE INVENTION

Therefore, the object of the present invention is to improve upon the aforedescribed arrangement in such a manner that the fabrication costs are significantly reduced, while at the same time increaseing the safety reliability factors.

In the present arrangement, the barrel probe lies in its safety position in the ignition path between the delay element and the active charge so as to block its ignition path. The barrel probe is therefore arrested in its safety position by the acceleration probe located in the safety position and with the projectile located in the firing barrel additionally by the firing barrel wall. A second pyrotechnical delay element that can also be ignited while firing is provided which exhibits a shorter delay period than that of the other delay element and which moves the barrel probe by means of the gas pressure into its end safety position following the expiration of the delay period of such other delay element.

Thus, in the present arrangement not only two independent physical values are used for safety, but two different types of physical values, viz. first the mechanics as in the past, secondly, the pyrotechnics. In so doing, it is to be pointed out that at present pyrotechnical delay compositions are manufactured quite precisely relative to their delay period, and at comparatively low cost. Because of this fact alone significant savings of cost can be realized compared to the purely mechanically acting arrangement of the prior art. In addition, the safety range relative to impermissible deceleration, e.g., though an obstacle, expands even outside the firing barrel as far as to the methodical release of the igniter train.

DETAILED DESCRIPTION OF THE INVENTION

The safety device is located in the bottom region of the projecting body and represents the connecting member between the charge or a special igniter charge associated with such charge 22 and the active charge, or a special igniter charge associated with such active charge.

Figure 1:
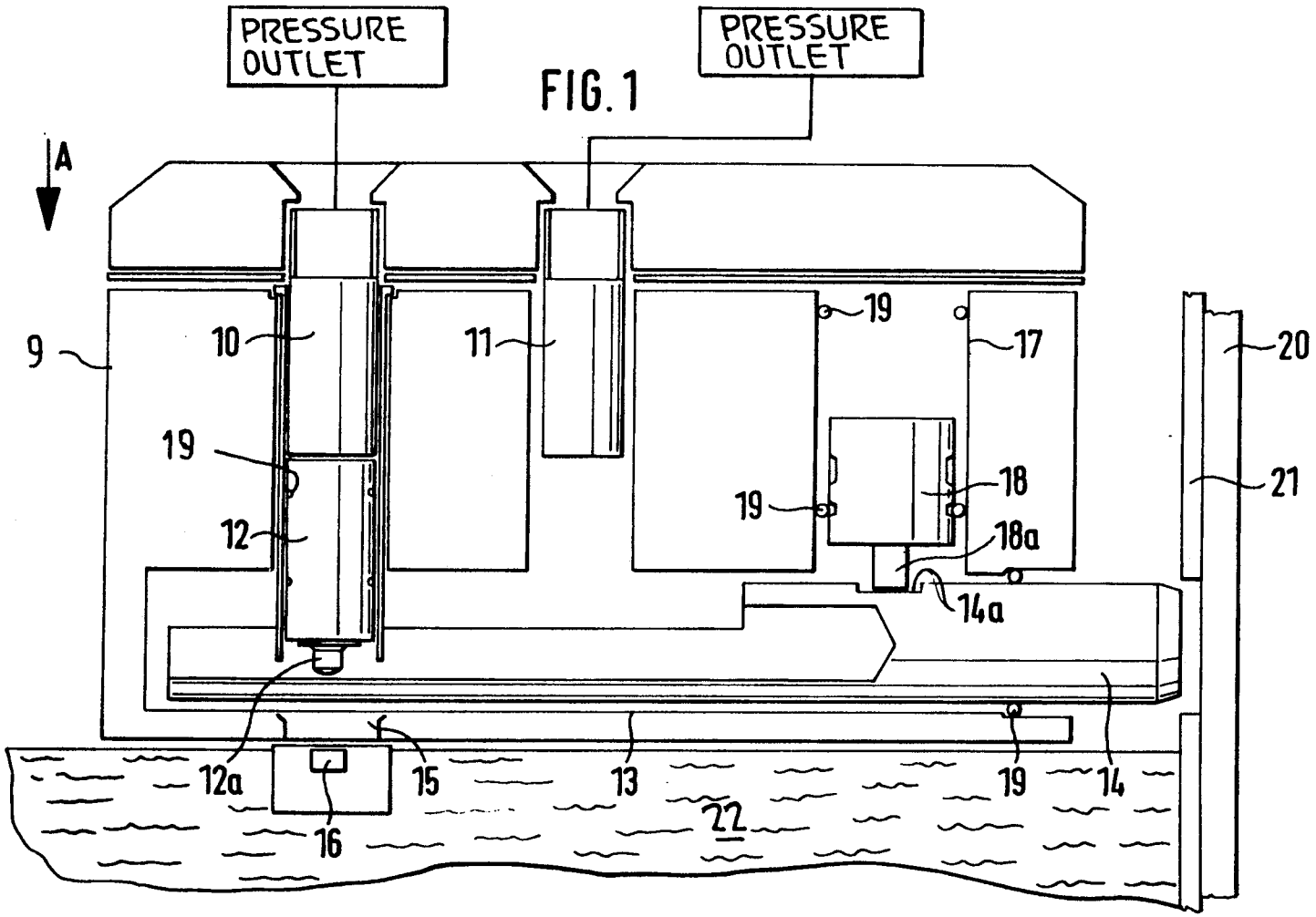
FIG. 1 is a schematic showing of the arrangement according to the invention.

Only those elements required for an understanding of the invention are shown in FIG. 1, other elements being eliminated for the sake of clarity.

The arrangement according to FIG. 1 includes two parallel pyrotechnical delay compositions extending in the discharge direction (arrow A). Such compositions are normally referred to as delay elements or adjustable time delay fuses shown as a first delay element 10 and a second delay element 11. The first delay element 10 is located coaxially behind a striker 12 having a head **12*a* projecting into a channel 13 of a housing 9. Channel 13** extends at right angles to the discharge direction A.

A barrel probe 14 can be housed as a bolt with a retracted stock in known manner so as to slide in channel 13. In the position shown in FIG. 1 head **12*a* of striker 12 abuts the stock of the barrel probe, or striker 12 is retained elsewhere by the barrel probe 14 in the starting position. A short barrel segment 15 diverges diametrically to striker 12 from channel 13 in the discharge direction A. A percussion cap 16**, which serves to ignite the active charge of the projectile (not illustrated) is located in the middle of the bottom of the barrel segment.

Second delay element 11 and a channel 17 of housing 9, which also extends in the discharge direction A and in which an acceleration probe 18 slides, also open into channel 13. In the position shown in FIG. 1, a head **18*a* of acceleration probe 18 extends into a recess 14*a* provided on the jacket of barrel probe 14**.

Moreover, the arrangement also includes elastic arresting rings 19, which serve as stops for the sliding members of the arrangement, namely for striker 12, barrel probe 14 and acceleration probe 18.

FIG. 1 shows the arrangement in the safety position. Barrel probe 14 lies with its stock located between striker 12 and percussion cap 16, such that the igniter train from first delay element 10 to the active charge 22 is interrupted.

Thus, barrel probe 14 is assured in this position in a twofold manner, first by the wall of the firing barrel 20, into which the projectile with its envelope 21 is located, and secondly by acceleration probe 18 which fits with its head 18*a* into recess 14*a* of barrel probe 14.

Figure 2:
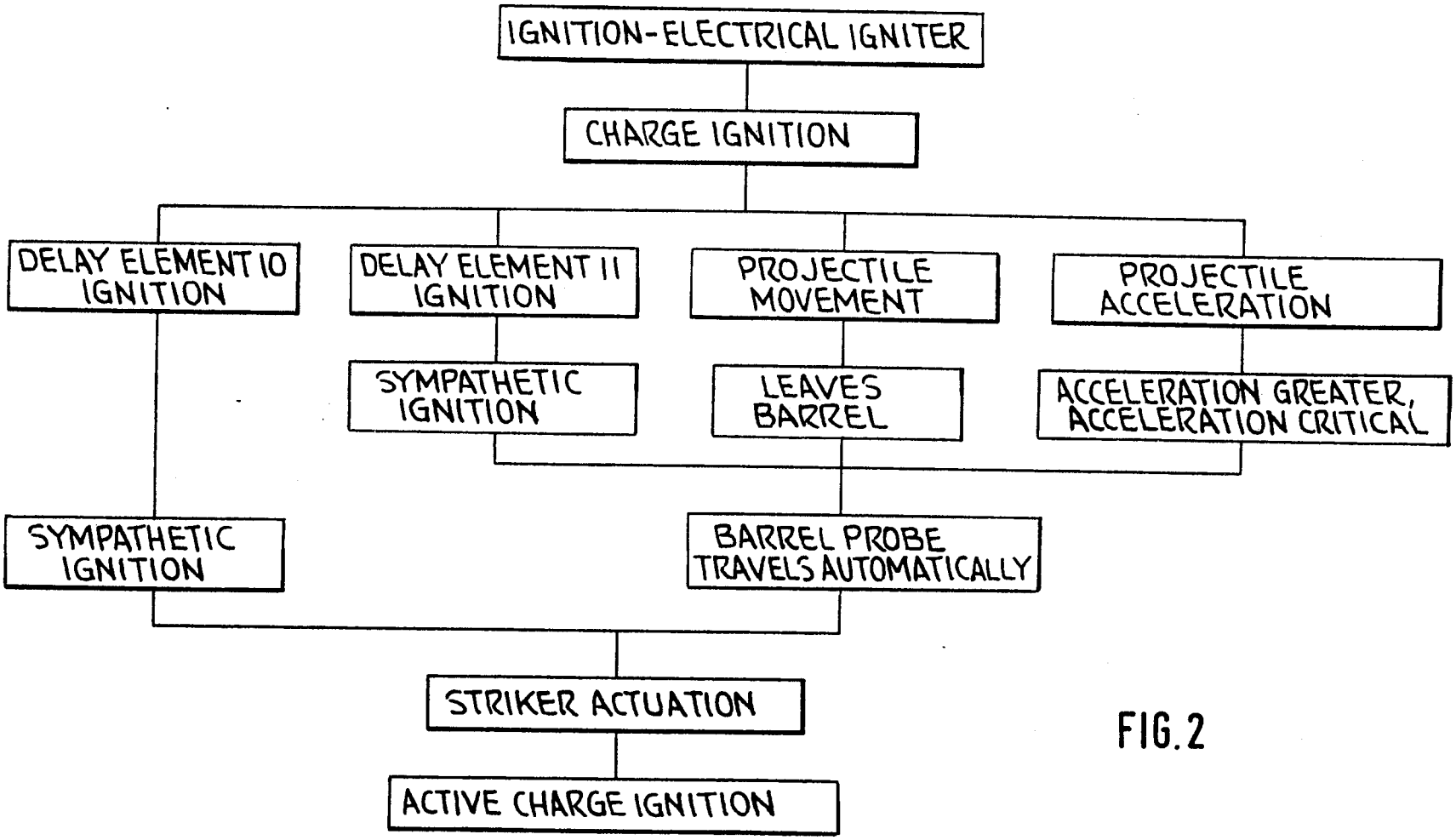
FIG. 2 is a flow diagram explaining the function of the FIG. 1 arrangement.

If at this stage the charge is ignited by means of the typical electric igniter, the result is a sequence of events illustrated in FIG. 2. That is, the hot gas of the igniter charge sets the projectile into motion and simultaneously ignites the two delay elements 10, 11. As soon as the projectile has reached its maximum acceleration, acceleration probe 18 moves in a direction opposite that of arrow A as a consequence of its inertia, such that its head 18*a* retracts out of recess 14*a* of barrel probe 14, and then locks into its upper locking position.

Barrel probe 14 remains, however, in its safety position, and especially even if the projectile has left the firing barrel, because no force has yet been exerted on barrel probe 14 in the direction with its safety disengaged (i.e., displacement to the right in FIG. 1). Not until delay element 11 has burned out, does pressure, which moves the barrel probe 14 outwardly so that the path between the striker 12 and the percussion cap 16 is free, form in channel 13 owing to the combustion gas. As soon as delay element 10 has burned out, its waste gases accelerate striker 12, so that its head 12*a* strikes the percussion cap 16, which in turn ignites the active charge.

Thus, the mass of acceleration probe 18 is designed in such a manner that it does not move into its position releasing barrel probe 14 until the projectile has reached an acceleration sufficient to fire the projectile ballistically beyond the safety zone of the front end of the barrel. If despite reaching this acceleration the projectile upon leaving the barrel is still significantly decelerated within the front end of the barrel safety zone due to some impediment, acceleration probe 18 moves in the opposite direction back again into the position locking barrel probe 14, which has, of course, not yet moved outwardly. The delay period of delay element 11 is set in such a manner that at the instant of its burning out, the projectile—correctly accelerated—has reached the end of the front end of the barrel safety zone. By contrast, the delay period of delay element 10 is set to the desired time for igniting the active charge, where in any event the delay period of delay element 10 is thus longer than that of delay element 11. If, owing to a malfunction, the delay period of delay element 10 is shorter than that of delay element 11, the igniter train remains interrupted and in the safety position. To provide barrel probe 14 or striker 12 the requisite thrust force, it is expedient that the two delay elements 10, 11 each be provided with a reinforced pressure outlet or that another pyrotechnic composition be attached as the pressure generator on the end of the delay element.

From the aforedescribed it can be seen that with the arrangement according to the invention an ignition of the active charge is possible only if a) the projectile has left the firing barrel, b) the projectile has experienced adequate acceleration, c) following discharge a specified time period has expired that ensures a sufficient safety distance of the projectile from the barrel mouth, d) during the period of time of c) the speed of the projectile has not decelerated significantly.

Despite this high safety, the present arrangement can be manufactured economically at costs significantly below those of a comparable, purely mechanical safety arrangements.

What is claimed is:

1. An arrangement to prevent a premature ignition of an active charge that is to be ignited by means of an adjustable time-delay fuse and is provided for a projectile that is expended from a firing barrel by means of a charge, comprising a housing including a pyrotechnical delay element that can be ignited while firing and in turn-ignites an active charge, an acceleration probe located in a safety position in the housing and during acceleration of the projectile to a specified firing velocity moves as a consequence of its inertia opposite a firing direction into an end safety position, and a barrel probe in the housing movable at right angles to the firing direction and movable out of a safety position thereof within a projectile shell into an end safety position in which it projects laterally beyond a jacket of the projectile, the delay element and the active charge interacting for ignition only if the acceleration probe and the barrel probe are simultaneously in the end safety position, wherein the barrel probe lies in its safety position in an ignition path between the delay element and the active charge and blocks the ignition path, whereby the barrel probe is arrested in its safety position by the acceleration probe located in the safety position and with the projectile located in the firing barrel additionally by a firing barrel wall 70, and wherein a second pyrotechnical delay element which can also be ignited while firing is provided and has a shorter delay period than that of the first-mentioned delay element and which moves the barrel probe by means of gas pressure into its end safety position following the expiration of the delay period of the first-mentioned delay element

2. The arrangement according to claim 1 wherein the delay elements can be ignited by the hot waste gases of the charge.

3. The arrangement according to claim 1, wherein the delay elements are each provided with a reinforced pressure outlet.

4. The arrangement according to claim 1, wherein a striker follows and a percussion cap precedes an active charge in the first-mentioned delay element, the striker having a head projecting toward the ignition cap, and the barrel probe is located in the safety position between the striker head and the percussion cap.

5. The arrangement according to claim 4, wherein the barrel probe and the accelerator probe are fixed in their safety position by means of elastic rings.

6. The arrangement according to claim 5, wherein the accelerator probe is also fixed in its end safety position by means of elastic rings.

* * * * *